US005295374A

United States Patent [19]

Bender et al.

[11] Patent Number: 5,295,374

[45] Date of Patent: Mar. 22, 1994

[54] TAILGATE HANDLE ASSEMBLY WITH WINDOW RELEASE SWITCH

[75] Inventors: Frederick F. Bender, South Lyon, Mich.; Ralph G. Nedbal, St. Charles, Ill.

[73] Assignee: Chrysler Corporation, Highland Park, Mich.

[21] Appl. No.: 980,039

[22] Filed: Nov. 23, 1992

[51] Int. Cl.[5] ..... E05B 65/19

[52] U.S. Cl. ..... 70/208; 49/394; 70/257; 70/264; 70/277; 70/DIG. 30; 292/201; 292/DIG. 3; 292/DIG. 21; 292/DIG. 25; 292/DIG. 43; 296/106

[58] Field of Search ..... 70/257, 208, 277, 264, 70/DIG. 30; 292/144, 201, DIG. 29, DIG. 43, DIG. 25, DIG. 21, DIG. 42, DIG. 3; 49/394; 296/106, 146 E, 146.8

[56] References Cited

U.S. PATENT DOCUMENTS

| | | | |
|---|---|---|---|
| 2,793,907 | 5/1957 | Hess et al. | 292/144 X |
| 3,587,259 | 6/1971 | Sandor | 70/218 |
| 4,155,233 | 5/1979 | Lira | 70/92 |
| 4,157,844 | 6/1979 | Sarosy et al. | 292/DIG. 43 X |
| 4,312,202 | 1/1982 | Pastva, Jr. et al. | 70/472 |
| 4,321,812 | 3/1982 | Pelcin | 70/472 |
| 4,898,413 | 2/1990 | Bertolini | 292/336.3 |
| 4,969,672 | 11/1990 | Childs et al. | 292/201 |
| 5,035,449 | 7/1991 | Shiratori et al. | 296/106 X |
| 5,174,619 | 12/1992 | Bender et al. | 70/279 X |

FOREIGN PATENT DOCUMENTS

| | | | |
|---|---|---|---|
| 2337940 | 2/1975 | Fed. Rep. of Germany | 292/201 |
| 2580321 | 10/1986 | France | 292/201 |
| 0217581 | 8/1990 | Japan | 292/DIG. 3 |

*Primary Examiner*—Lloyd A. Gall
*Attorney, Agent, or Firm*—Edward P. Barthel

[57] ABSTRACT

A tailgate handle assembly in a housing including a flush-mounted handle and an adjacent key cylinder. The housing is spaced apart from a tailgate latch mechanism. A laterally extending lever is slidably actuated on the housing from a locked mode to an unlocked mode manually by rotation of the key cylinder, or electrically via a power actuator, and then pivoted by manual lift-pulling on the handle, to thereby lift a latch rod extending between the lever and the latch mechanism to actuate the latter. An electrical limit switch is mounted on the handle assembly, adapted to being actuated by one slidable movement of the lever to unlock the latch of an upwardly pivotable tailgate window.

4 Claims, 5 Drawing Sheets

TAILGATE HANDLE ASSEMBLY WITH WINDOW RELEASE SWITCH

TECHNICAL FIELD

This invention relates generally to tailgate lock mechanisms and, more particularly, to a handle assembly therefor including a window release limit switch.

BACKGROUND ART

Childs et al U.S. Pat. No. 4,969,672 and Lira U.S. Pat. No. 4,155,233 disclose deck lid release mechanisms wherein the key cylinder and actuator apparatus are located with the latch near the bottom of the deck lid.

Pastva, Jr. et al U.S. Pat. No. 4,312,202 and Pelcin U.S. Pat. No. 4,321,812 each disclose a key cylinder and a handle in the same housing with a latching bolt.

Bertolini U.S. Pat. No. 4,898,413 discloses a handle pivotally mounted in a recess in a front plate. Manual movement of the handle operates through oppositely disposed pairs of links to pivot a laterally extending lever about an intermediate pin, with an end of the lever adapted to actuate latch opening linkage.

Sandor U.S. Pat. No. 3,587,259 discloses a handle, pin, and lever rotatable as a unit.

None of these tailgate release arrangements includes an integrally mounted window lift switch, adapted to being actuated during one of the operational steps of the release mechanism.

DISCLOSURE OF THE INVENTION

A general object of the invention is to provide an improved tailgate handle assembly including an integrally mounted window lift limit switch.

Another object of the invention is to provide an improved tailgate handle assembly as part of a tailgate and window latching system with a minimum number of components.

A further object of the invention is to provide a tailgate key cylinder and handle assembly including a laterally extending lever which is slidably actuated from a locked mode to an unlocked mode by manual rotation of the key cylinder or by power actuation, to thereby concurrently actuate a limit switch to unlatch the rear pivotable window; the lever is then pivoted by manual lift-pulling on the handle, to thereby lift a latch rod secured at the upper end thereof to the lever and at the lower end thereof to a latch mechanism to unlatch the tailgate.

These and other objects and advantages of the invention will become more apparent when reference is made to the following drawings and the accompanying description.

BRIEF DESCRIPTION OF THE DRAWINGS

FIG. 3 is a front view of the inventive housing assembly, and remote mounted tailgate latch and power actuator therefor;

BEST MODE OF CARRYING OUT THE INVENTION

Figure 1:
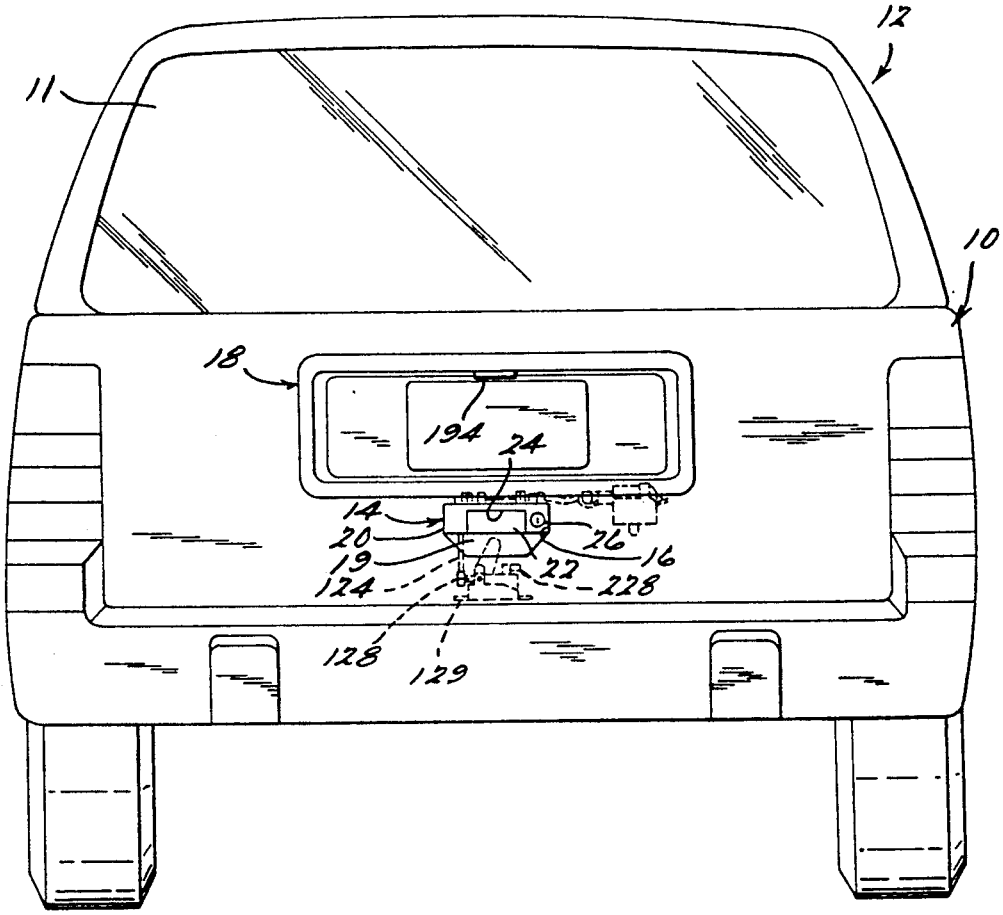
FIG. 1 is a rear view of a vehicle illustrating its tailgate, rear window, and a housing assembly embodying the invention.
Figure 2:
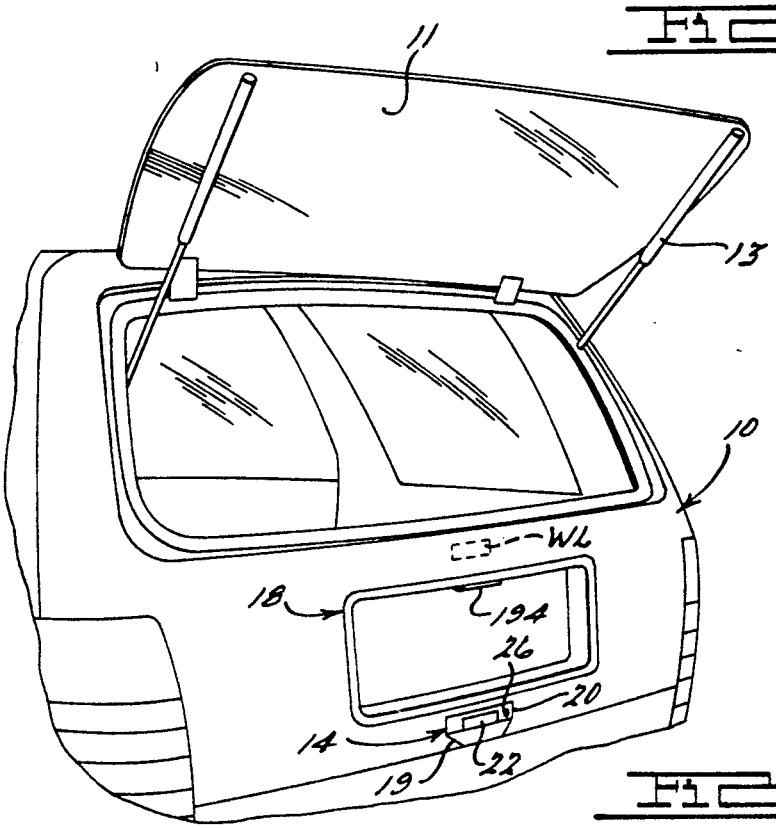
FIG. 2 is a perspective view of the vehicle with its rear window pivoted to an open position.
Figure 2:
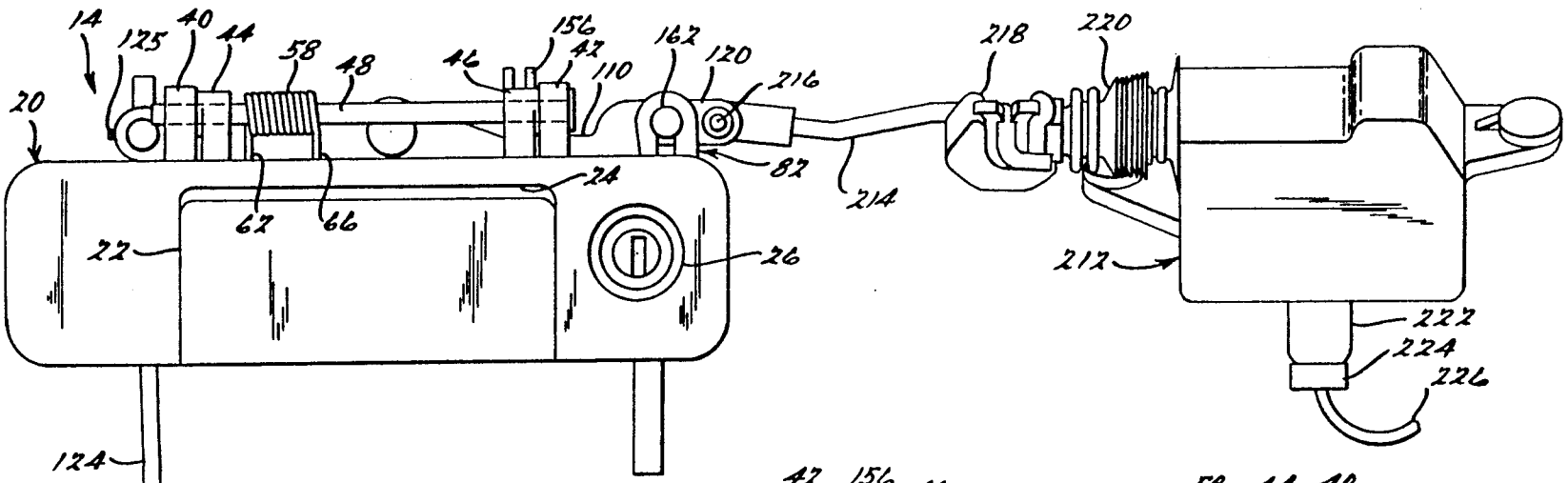

Referring now to the drawings in greater detail, FIGS. 1 and 2 illustrate a tailgate 10 and adjacent window 11 of a vehicle 12, the latter raised into a fully open position by gas cylinder actuator or pump 13 at opposite sides thereof. A liftgate outside handle assembly 14 is mounted in an opening 16 formed in a central portion of the tailgate 10, just below the usual license plate mounting frame 18 formed in the tailgate and above a recess 19 formed therein. As such the assembly 14 is positioned as high as possible above the lower end of the tailgate 10, away from any water and contaminants that may be lifted up from the roadway.

The handle assembly 14 includes a housing 20 having a flush-type, pull-to handle 22 pivotally mounted in a central pocket 24 in the housing, as will be explained, and a key cylinder 26 rotatably mounted in one end of the housing.

Figure 11:
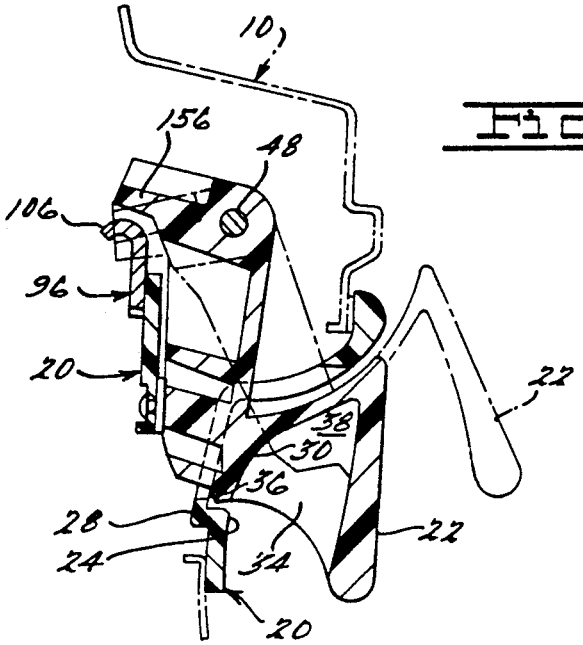
FIG. 11 is a cross-sectional view taken along the plain of the line 11—11 of FIG. 5, and looking in the direction of the arrows, and illustrating two operational positions of a portion of the invention.

As shown in FIGS. 4–6 and 9, an arcuate-shaped wall 28 forms the back of the pocket 24. Similarly, an arcuate-shaped back wall 30 (FIG. 11), connected by short side walls 32 and 34 to the handle 22, abuts against a recessed surface 36 formed in the wall 28. The walls 30, 32 and 34 form a pocket 38 behind the handle 22 for the insertion therein of an operator's fingers above the recess 19.

Figure 10:
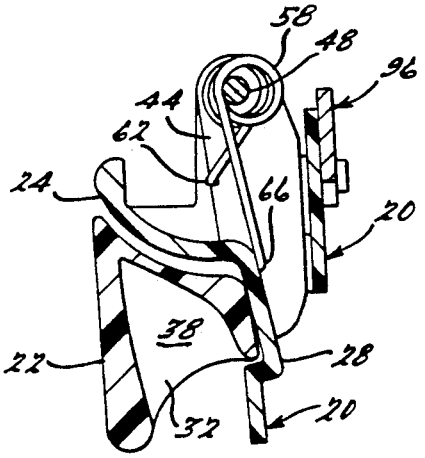
FIG. 10 is a cross-sectional view taken along the plain of the line 10—10 of FIG. 5, and looking in the direction of the arrows.

Referring again to FIGS. 4–6, it is noted that two spaced-apart, upwardly extending mounting flanges 40 and 42 are formed on the back side of the housing wall 28. A pair of upwardly extending mounting arms 44 and 46 are formed on the back side of the handle wall 30, adapted to extend upwardly adjacent the inside surfaces of the respective mounting flanges 40 and 42. A pivot pin 48 extends through aligned openings 50, 52, 54, and 56 formed adjacent the upper ends of the respective mounting members 40, 44, 42, and 46, such that the mounting arms 44 and 46 are pivotally mounted thereon, to accommodate the manual lifting of the handle 22. A coil spring 58 is mounted around the end portion of the pin 48 adjacent the mounting arm 44. An end wire 60 extending from one end of the spring 58 extends downwardly along side the arm 44, with a bent end 62 (FIG. 10) thereof extending laterally so as to lie on the front edge 64 of the arm 44. A second end wire 66 (FIG. 10) extending from the other end of the spring 58 extends downwardly so as to engage the back side of the wall 28 forming the pocket 24 in the housing 20. As such, the coil spring 58 and its ends 62 and 66 serves to urge the handle 22 into its closed, flush position in the housing 20.

Figure 4:
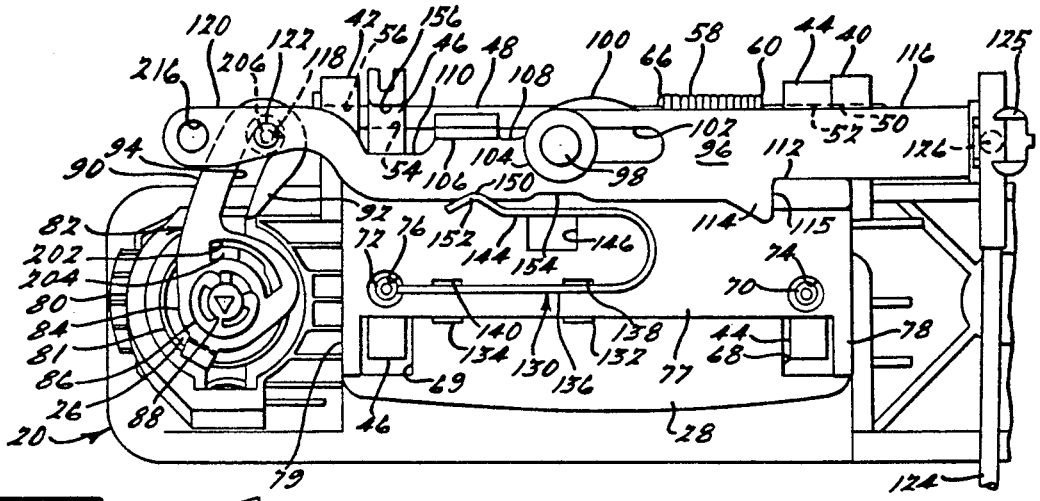
FIGS. 4–6 are rear views of the housing assembly of FIG. 2 illustrating three operational conditions thereof.

As shown in FIG. 4, the upwardly extending mounting arms 44 and 46 extend through respective openings 68 and 69 formed in the back wall 28 of the housing pocket 24. When the back wall 30 of the handle 22 is urged by the spring 58 into the recessed surface 36 of the housing wall 28, the arms 44 and 46 abut against respective rubber stops 70 and 72 mounted in holes 74 and 76 formed in an additional back wall 77 having side walls 78 and 79 molded between the housing upwardly extending mounting flanges 40 and 42.

Referring further to FIG. 4, it is noted that the key cylinder 26 is inserted into and rotatably mounted in an enclosure 80 molded as an integral part of the back of the housing 20 adjacent a side of the pocket 24. A coil spring, represented as 81, is mounted around the cylinder 26 exterior of the enclosure 80, serving to return the cylinder to center after a key (not shown) has rotated the cylinder.

A hook-like key cylinder lever 82 is secured at its lower body portion 84 by a suitable fastener 86 to an extension 88 of the key cylinder 26. An upwardly extending arm 90 is formed on the lower end portion 84, and a downwardly extending finger 92 is formed on the arm 90, such that an open-ended slot 94 is formed between the arm 90 and the finger 92 for a purpose to be described.

A main lever 96 is laterally slidably mounted on the upper portion of the back side of the back wall 77. Specifically, a pin 98 is mounted through an upwardly tapered extension 100 of the back wall 77, and a slot 102 is formed in a mid-section of the lever 96 for mounting on the pin 98. A washer 104 retains the lever 96 on the pin 98.

A bent-over lip 106 is formed on a top edge 108 of the lever 96 adjacent one end of the slot 102. A groove 110 is formed in the top edge 108 adjacent the lip 106. An abutment 112 is formed on the back wall 77 for cooperation with a lug 114 formed on the bottom of the lever 96 midway between the slot 102 and the end 116 of the lever on the side thereof opposite the lip 106. The lug 114 includes a vertical face 115 f or at times engaging the abutment 112.

An opening 118 is formed adjacent the other end 120 of the lever 96. A pin 122 is mounted through the opening 118 intermediate the end 120 and the groove 110 thereof. The pin 122 extends through the open-ended slot 94 of the key cylinder lever 82 at the juncture of the arm 90 and the finger 92. A contour 123 (FIG. 5) is formed adjacent the juncture to prevent the pin 122 from binding in the slot 94.

A latch release rod 124 is secured at its upper end to a connector clip 125 which is pivotally mounted in an opening 126 formed adjacent the end 116 of the lever 96. The rod 124 extends downwardly so as to be operatively connected to a latch lever 128 (FIG. 3) extending from a latch mechanism 129 in FIG. 1, located adjacent the bottom edge of the tailgate 10.

Referring once again to FIG. 4, it is noted that a U-shaped leaf spring 130 is mounted on the bottom portion of the back wall 77, below the lever 96. Two mounting tabs 132 and 134 formed on the bottom leg 136 of the leaf spring 130 extend through respective openings 138 and 140 of the back wall 77 and downwardly therefrom to secure the bottom leg thereon. An upwardly turned tab 142 (FIG. 6) formed at an intermediate portion of the upper leg 144 of the leaf spring 130 extends through a square opening 146 in the back wall 77. The upper edge 148 of the opening 146 serves as a stop for the tab 142 and the associated upper leg 144. A convex bend 150 is formed on the distal end of the upper leg 144 for cooperation with each of two spaced recessed portions 152 and 154 formed on the bottom edge of the lever 96.

An actuator lug 156 is formed on the upper end of the mounting arm 46, extending across the space above the groove 110 in the top edge 108 of the lever 96 when the latter is in its rightmost or locked mode position, as viewed in FIG. 4. If the handle 22 were pulled or pivoted outwardly from the housing 20 while the lever 96 is in this locked mode position, the actuator lug 156 would merely move through the space above the groove 110, without moving the lever 96, and, therefore, without unlatching the latch 128.

Figure 7:
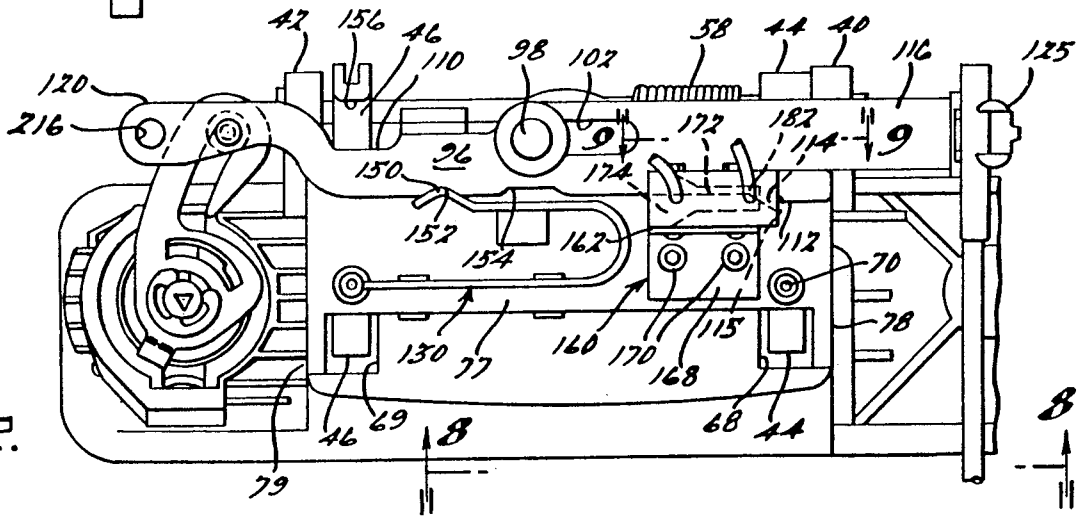
FIG. 7 is view similar to FIG. 4, including an integrally mounted window lift switch arrangement.
Figure 8:
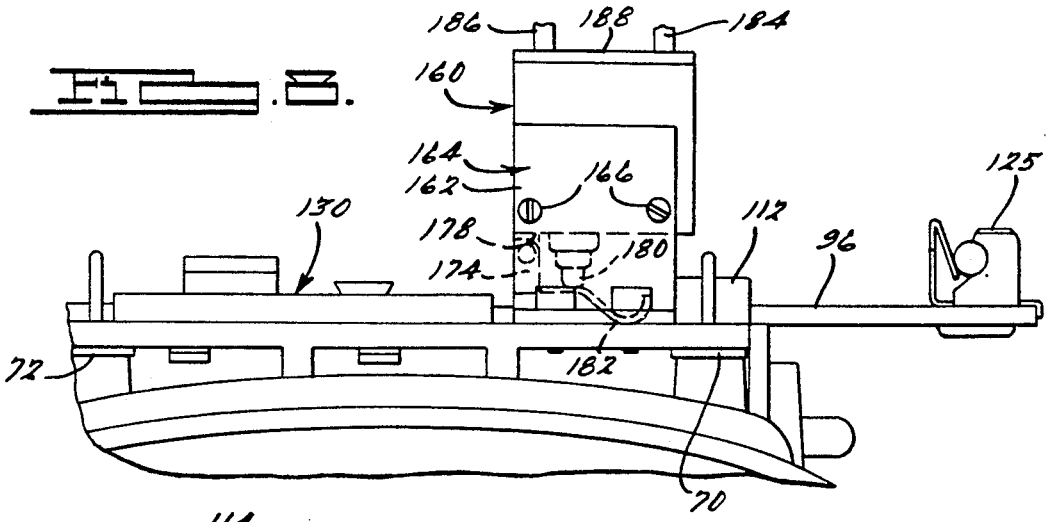
FIG. 8 is a fragmentary view taken along the plane of the line 8—8 of FIG. 7, and looking in the direction of the arrows.

As shown in FIGS. 7 and 8, an electrical limit switch assembly 160 is mounted on one leg 162 of an L-shaped bracket 164, and secured thereon by fasteners, such as bolts and nuts 166. The other leg 168 of the bracket 164 is secured by fasteners, such as screws 170, to the back wall 77 adjacent the bend of the U-shaped leaf spring 130.

Figure 9:
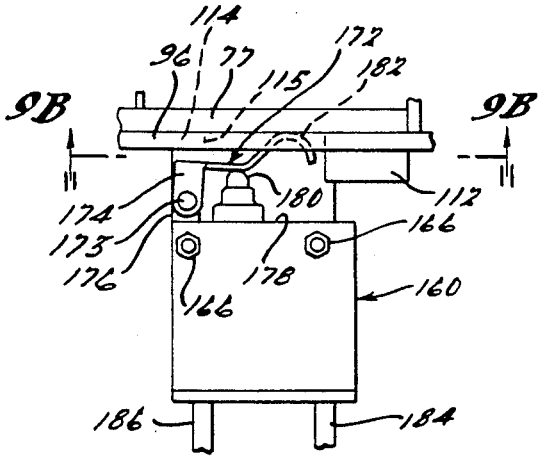
FIG. 9 is a fragmentary view taken along the plane of the line 9—9 of FIG. 7, and looking in the direction of the arrows.
Figure 9A:
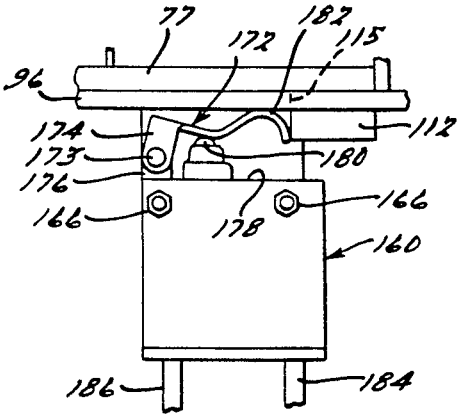
FIG. 9A is a view similar to FIG. 9, showing a different operational view.

As shown in FIG. 9, a leaf arm 172 is pivotally attached by a pivot pin 173 at one flanged end 174 thereof to an extension 176 formed on an end face 178 of the assembly 160 closest to the wall 77. A spring-loaded, reciprocally movable projection 180 extends from the end face 178 of the assembly 160, abutting against a mid portion of the leaf arm 172, causing the bent distal end 182 of the leaf arm to abut against one of the back wall 77 (FIG. 9) or the lever 96 (FIG. 9A), as will be explained.

Wire leads 184 and 186 extend from the outer end face 188 (FIG. 8) of the switch assembly 160 to the vehicle battery 190 (FIG. 14) and to a solenoid 192 via a pushbutton 194. The solenoid 192 is operatively connected to the latch (W6) associated with the tailgate window 11.

Figure 14:
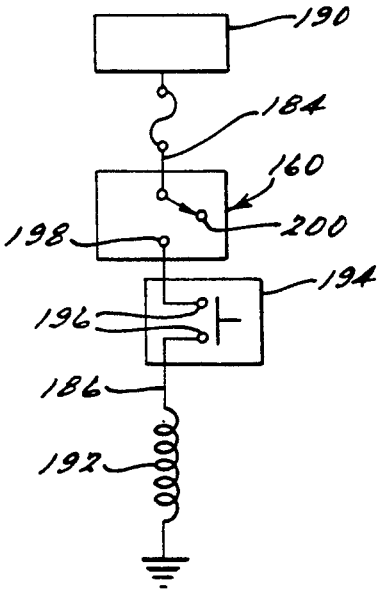
FIG. 14 is a wiring diagram for the switch arrangement of FIGS. 7 and 8.

As shown in FIG. 14, a pushbutton 194 is connected in series intermediate the solenoid 192 and the limit switch assembly 160. Structurally, the pushbutton 194 is located on the tailgate outer panel above the license plate pocket (FIG. 1) on the centerline of the vehicle. The pushbutton 194 is adapted to complete the circuit, via its terminals 196 from the limit switch assembly 160 containing unlock and lock terminals 198 and 200, respectively, to the solenoid 192.

Figure 9B:
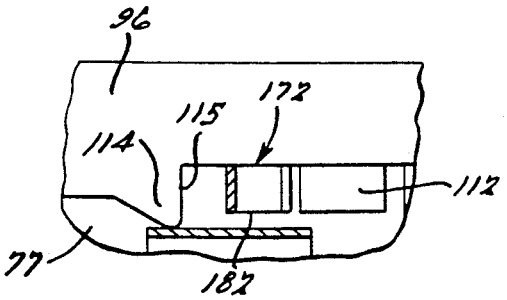
FIG. 9B is a fragmentary cross-sectional view taken along the plane of the line 9B—9B of FIG. 9, and looking in the direction of the arrows.

In operation, once a key is inserted in the key cylinder 26 and rotated clockwise (FIG. 1) approximately a one-eighth turn, the lower body portion 84 of the key cylinder lever 82 is similarly rotated to thereby cause the pin 122 in the open-ended slot 94 to move laterally with the arm 90 and finger 92 and, hence, to move the lever 96 to its leftmost or unlocked mode position (FIG. 5) as permitted by the movement of the pin 98 in the slot 102 in the lever 96. This brings the bent-over lip 106 into position just below the actuator lug 156, and frees the bent end 182 of the leaf arm 172 of the switch assembly 160 from the lug 114 of the lever 96 (FIG. 9B), allowing it to abut against the back wall 77, and allowing the spring-loaded projection 180 to project outwardly (FIG. 9), opening the circuit within the assembly 160 to thereby unlatch the window 11.

While the lever 96 is in the leftmost position just described, when the handle 22 is pulled outwardly, the actuator lug 156 engages the bent-over lip 106, urging it and its associated lever 96 in a counterclockwise rotation about the pin 98 (FIG. 5), against the force of the upper leg 144 of the spring 130, which has its convex bend 150 seated in the recessed portion 154 on the bottom edge of the lever 96.

The result of the counterclockwise movement of the lever 96 is to move the pin 122 downwardly in the open-ended slot 94 between the arm 90 and the finger 92 of the key cylinder lever 82, and the end 116 of the lever 96 upwardly, causing the latch rod 124 to be lifted, to thereby raise the latch lever 128 (FIG. 2) and unlatch the latch mechanism 129 (FIG. 1) for opening the tailgate 10.

When the tailgate 10 is once again closed, and the handle 22 released, rotation of the key counterclockwise (FIG. 1) in the key cylinder 26 approximately a one-eighth turn moves the lever 96 to the right or locked mode in FIG. 4 via the corresponding action of the key cylinder lever 82, until the left end of the slot 102 engages the pin 98, to thereby render any lifting of the handle 22 ineffective, and retain the tailgate 10 in a locked condition.

At this point, the convex bend 150 of the leaf spring 130 seats in the recessed portion 152 on the bottom edge of the lever 96. It should be noted that when the convex bend 150 of the leaf spring 130 is seated in either of the recessed portions 152 or 154, a positive stop is thereby provided which prevents the main lever 96 from being accidentally jarred from one of the locked or unlocked mode to the other by any lateral load against the vehicle.

Figure 5:
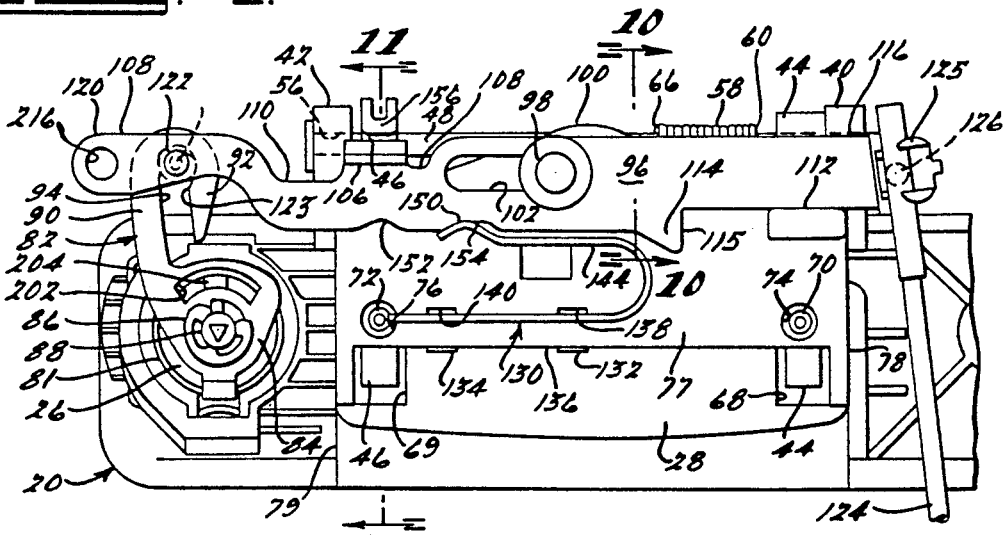
Figure 6:
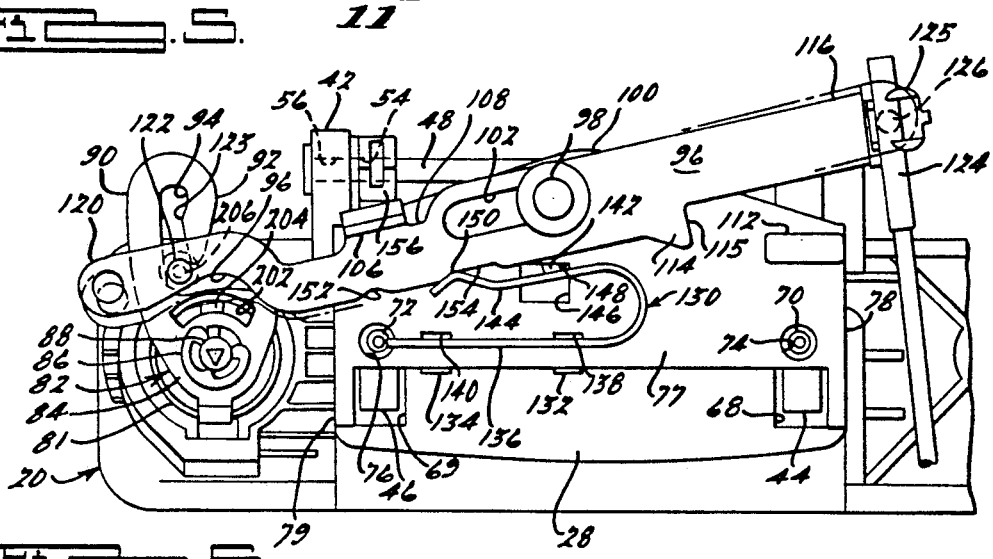
Figure 12:
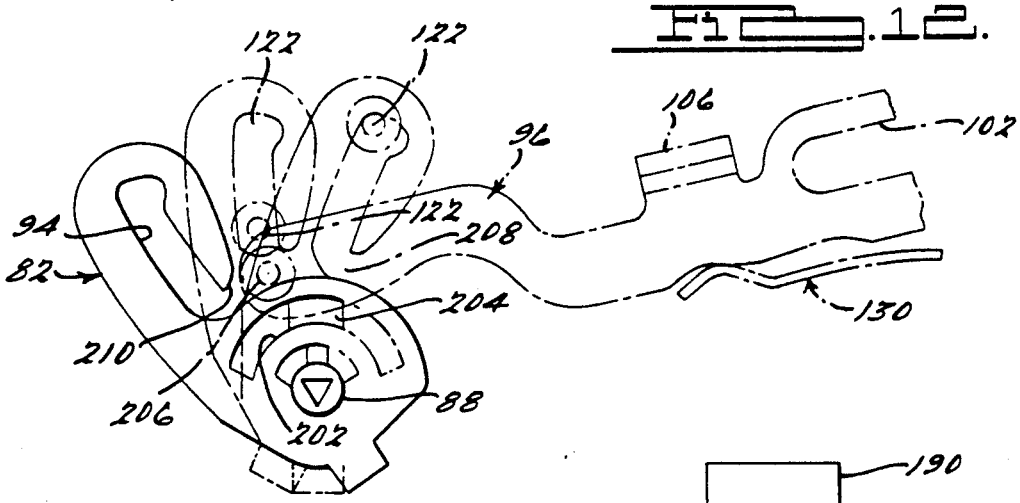
FIG. 12 is an enlarged view of a portion of the FIGS. 4–6 structure illustrating three operational positions thereof.

Referring now to FIGS. 4, 5 and 12, the key cylinder lever 82 is shown to include an arcuate-shaped slot 202 concentric with the extension 88 of the key cylinder 26. The key cylinder lever 82 and, hence, the slot 202 pivots about a fixed tab 204 on the back of the key cylinder 26 from the left end (FIG. 4) of the slot 202 to a central point (FIG. 5) along the slot as the main lever 96 moves laterally from the locked to the unlocked modes. At assembly of the handle assembly 14, the key cylinder lever 82 is rotated such that the tab 204 is positioned in the extreme right end (FIG. 12) of the slot 202. In this position, the small diameter portion 206 of the pin 122 is slipped through the opening 208 between the distal end 210 of the finger 92 and the lower body portion 84, into the open end of the open-ended slot 94, and the lever 82 is then rotated clockwise to position the fixed tab 204 for its two operational positions (FIGS. 4 and 5), and retain the pin 122 in its operative position in the open-ended slot 94.

As an optional arrangement, a power actuator 212 (FIG. 3) may be mounted intermediate the outer and inner walls of the tailgate 10, and connected to the lever 96 adjacent the end 120 of the latter. Specifically, a connector rod 214 is connected between an opening 216 formed in the end 120 and an end 218 of a power actuator 220 reciprocally mounted in the actuator 212. An electrical connection 222 mounted on the bottom surface of the actuator 212 is adapted to receive a connector 224 of a lead line 226 extending from power door locks (not shown) . The power actuator 220 may be included in addition to key cylinder 26 to slidably move the lever 96 between the locked and the unlocked positions while the operator is inside the vehicle.

If desired, an electrical connection, represented as 228 in FIG. 1, is mounted on the latch mechanism 129 and operatively connected to an indicator within the vehicle to indicate to the operator whether the tailgate is open or closed.

Figure 13:
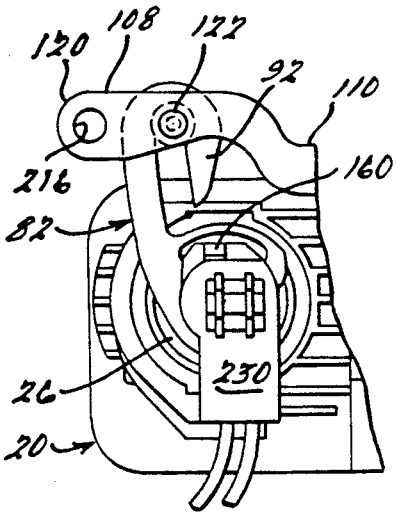
FIG. 13 is a fragmentary view of a portion of the FIG. 5 structure illustrating the inclusion of an additional component mounted thereon.

Additionally, if desired, a security alarm switch 230 may be mounted on the back of the key cylinder 26 (FIG. 13). The switch is operatively connected to an alarm (not shown) and adapted to sound the alarm in the event an attempt is made to punch out the key cylinder.

INDUSTRIAL APPLICABILITY

It should be apparent that the invention provides an efficient, compact liftgate housing assembly, containing all of the pull-to handle, the key cylinder, and a tailgate window latch limit switch assembly.

It should also be apparent that the invention provides a liftgate handle assembly including a handle, a key cylinder, and a main lever which is slidably moved between a locked mode and an unlocked mode by rotation of the key cylinder, serving concurrently to latch and unlatch a pivotable tailgate window, in conjunction with a separate pushbutton, with the lever being pivotable by movement of the handle to actuate a remote mounted tailgate latch.

While but one embodiment of the invention has been shown and described, other modifications thereof are possible within the scope of the following claims.

What is claimed is:

1. In a tailgate handle assembly for actuating a remotely mounted tailgate latch and a pivotally mounted tailgate window latch, said tailgate handle assembly including a housing having a handle pivotally mounted therein, a key cylinder rotatably mounted therein, a lever slidably and pivotally mounted thereon and operably connected to said handle and said key cylinder, and a rod connected between said lever and said tailgate latch, said lever adapted to being reciprocally slidably actuated between a locked and an unlocked mode by rotation of said key cylinder and pivotally actuated by manual lifting of said handle to move said rod to thereby operate said tailgate latch, the improvement in combination therewith comprising a limit switch integrally mounted on said handle assembly and operatively connected to said window latch, said limit switch adapted to being closed by the reciprocal sliding movement of said lever to thereby unlatch said window latch.

2. The improvement described in claim 1, wherein said limit switch includes a bracket secured to said handle assembly, said limit switch secured to said bracket, a bent leaf arm pivotally mounted on said limit switch, and a reciprocally mounted projection extending from terminals within said limit switch and abutted against said bent leaf arm, said bent leaf arm adapted to move said projection to open and close a circuit to said window latch upon reciprocal sliding movement of said lever.

3. The improvement described in claim 2, and further comprising a lug formed on said lever adapted to engage said bent leaf arm during sliding movement of said lever.

4. A tailgate handle assembly spaced apart from a tailgate latch and a window latch, the handle assembly including a housing having a central pocket formed therein, a handle flush mounted in the housing and adapted to being pivotally lifted outwardly therefrom, a key cylinder rotatably mounted in the housing adjacent said pocket, a lever slidably and pivotally mounted in the housing to the rear of said pocket, means secured to said key cylinder and pivotally connected to said lever to slide same between locked and unlocked modes upon rotation of said key cylinder, means formed on said handle adapted to abut against and pivot said lever when in the unlocked mode upon the manual pivotal lifting of said handle, connector means between one end of said lever and said tailgate latch, the improvement in combination therewith comprising a lug formed on a lower edge of said lever, a fixed abutment formed in said housing, a limit switch mounted in said housing adjacent said fixed abutment, a leaf arm pivotally mounted at one end thereof on an end of said limit switch, a reciprocally mounted projection extending from said end of said limit switch adapted to close and open terminals within said limit switch and engaging a center portion of said leaf arm, and a bend formed on the other end of said leaf arm adapted to be moved toward said end of said limit switch upon engagement with said lug upon sliding movement of said lever to thereby urge said projection into said limit switch to effect opening or closing of said terminals.

* * * * *